US009851697B2

(12) United States Patent
Saito et al.

(10) Patent No.: US 9,851,697 B2
(45) **Date of Patent: *Dec. 26, 2017**

(54) ELECTRONIC APPARATUS EQUIPPED WITH SOLAR PANEL

(71) Applicant: CASIO COMPUTER CO., LTD., Shibuya-ku, Tokyo (JP)

(72) Inventors: Yuta Saito, Kokubunji (JP); Makoto Sawada, Nishitokyo (JP); Junro Yano, Hachioji (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/634,457

(22) Filed: Feb. 27, 2015

(65) Prior Publication Data

US 2015/0277389 A1 Oct. 1, 2015

(30) Foreign Application Priority Data

Mar. 26, 2014 (JP) ..... 2014-063373

(51) Int. Cl.

| | |
|---|---|
| ***G04G 19/00*** | (2006.01) |
| ***G04R 60/10*** | (2013.01) |
| ***G04C 10/02*** | (2006.01) |
| ***G04R 60/00*** | (2013.01) |
| ***G04R 60/06*** | (2013.01) |
| ***G04R 60/12*** | (2013.01) |

(52) U.S. Cl.

CPC ..... *G04G 19/00* (2013.01); *G04C 10/02* (2013.01); *G04R 60/00* (2013.01); *G04R 60/06* (2013.01); *G04R 60/10* (2013.01); *G04R 60/12* (2013.01)

(58) Field of Classification Search

CPC ..... G04C 10/02; G04R 60/02; G04R 60/06; G04R 60/10

USPC ..... 368/205

See application file for complete search history.

(56) References Cited

U.S. PATENT DOCUMENTS 3,427,797 A 2/1969 Negoro et al.
3,786,624 A 1/1974 Uchiyama
(Continued)

FOREIGN PATENT DOCUMENTS

EP 2447791 A1 5/2012
JP 59090076 A 5/1984
(Continued)

OTHER PUBLICATIONS

Hosaka et al., English Translation for JP201212211895, Nov. 1, 2012, whole document.*
(Continued)

*Primary Examiner* — Amy Cohen Johnson
*Assistant Examiner* — Daniel Wicklund
(74) *Attorney, Agent, or Firm* — Holtz, Holtz & Volek PC

(57) ABSTRACT

Disclosed is an electronic apparatus including a dial plate having light transparency, a module including an antenna for receiving circularly polarized waves which is disposed below the dial plate, the antenna having a radiation electrode, and a solar panel disposed between the dial plate and the module, wherein the solar panel includes a common substrate, a plurality of solar cells disposed on the common substrate, and an inactive segment disposed on the common substrate at a place corresponding to the place of the radiation electrode.

5 Claims, 4 Drawing Sheets

(56) References Cited

U.S. PATENT DOCUMENTS

| | | | | |
|---|---|---|---|---|
| 3,890,776 | A | 6/1975 | Urushida | |
| 4,038,104 | A | 7/1977 | Tsutomu | |
| 6,094,404 | A | 7/2000 | Hidai et al. | |
| 6,268,558 | B1 * | 7/2001 | Kubota | H01L 31/046 136/244 |
| 6,372,977 | B1 | 4/2002 | Miyoshi | |
| 6,901,033 | B2 | 5/2005 | Ito | |
| 7,136,138 | B1 | 11/2006 | Sekiguchi et al. | |
| 7,746,731 | B2 | 6/2010 | Murakami et al. | |
| 8,493,817 | B2 | 7/2013 | Baba | |
| 2009/0251997 | A1 * | 10/2009 | Kimura | G04R 60/10 368/47 |
| 2010/0097896 | A1 | 4/2010 | Baba | |
| 2011/0051561 | A1 | 3/2011 | Fujisawa | |
| 2011/0187609 | A1 | 8/2011 | Abe | |
| 2012/0002511 | A1 * | 1/2012 | Matsuzaki | G04C 10/02 368/10 |
| 2012/0002512 | A1 * | 1/2012 | Matsuzaki | G04C 10/02 368/205 |
| 2012/0105288 | A1 * | 5/2012 | Abe | G04C 10/02 343/702 |
| 2013/0051192 | A1 | 2/2013 | Oshio | |
| 2014/0060614 | A1 | 3/2014 | Saito | |
| 2014/0241131 | A1 * | 8/2014 | Honda | G04C 10/02 368/205 |
| 2014/0247705 | A1 * | 9/2014 | Saito | G04C 10/02 368/205 |
| 2015/0268639 | A1 | 3/2015 | Abe et al. | |
| 2016/0179061 | A1 | 2/2016 | Abe et al. | |

FOREIGN PATENT DOCUMENTS

| | | | | |
|---|---|---|---|---|
| JP | 2002221581 | A | * | 8/2002 |
| JP | 2010096707 | A | | 4/2010 |
| JP | 2011163913 | A | | 8/2011 |
| JP | 2012093288 | A | | 5/2012 |
| JP | 2012198150 | A | | 10/2012 |
| JP | 2012211895 | A | | 11/2012 |
| JP | 2013040794 | A | * | 2/2013 |
| JP | 2016092255 | A | | 5/2016 |

OTHER PUBLICATIONS

Sato, Masaaki, English Translation of JP 2002221581, originally published Aug. 9, 2002, full document.*

Japanese Office Action (and English translation thereof) dated Jan. 5, 2016, issued in counterpart Japanese Application No. 2014-063373.

Extended European Search Report dated Oct. 28, 2015, issued in counterpart European Application No. 15155303.9.

* cited by examiner

ELECTRONIC APPARATUS EQUIPPED WITH SOLAR PANEL

BACKGROUND OF THE INVENTION

1. Field of the Invention

The present invention relates to an electronic apparatus. In particular, the invention relates to an electronic apparatus that is equipped with a solar panel and receives GPS radio signals to correct time.

2. Description of the Related Art

Japanese Unexamined Patent Application Publication No. 2010-96707 discloses a timepiece which utilizes the Global Positioning System (hereinafter referred to as a "GPS timepiece"). The GPS timepiece is one of the electronic apparatuses capable of precisely correcting time anywhere in the world.

The GPS timepiece uses a global positioning system, i.e. a GPS receiver, which receives radio signals (hereinafter referred to as "GPS radio signals") sent from artificial satellites (GPS satellites) orbiting the Earth in space and determines the location of the receiver, so as to acquire correct time information superimposed on the GPS radio signals and correct the time.

The GPS radio signal is composed of circularly polarized microwaves. An antenna that is the most suitable for receiving such microwaves is a patch antenna, which is small and has excellent reception characteristics.

Electronic apparatuses equipped with solar panels that convert light into electricity are also widely known.

Such electronic apparatuses provided with solar panels can be used for long terms without the replacement of secondary batteries that can accumulate the electricity generated by the solar panels.

GPS timepieces equipped with solar panels are easy to handle and convenient for users because the GPS timepieces no longer require the users to correct time and replace the batteries.

A typical solar panel includes a metal electrode, a semiconductor layer, and a transparent electrode, which are formed of a conductive material, such as an aluminum conductor.

If a solar panel is disposed above an antenna, antenna characteristics (radio signal reception characteristics) are degraded significantly due to the influence of the conductive material.

To avoid this disadvantage, a configuration for preventing such degrading in antenna characteristics is proposed in Japanese Unexamined Patent Application Publication No. 2012-211895 in which a solar panel has a cutout at a portion facing an antenna so that no solar panel is disposed above the antenna.

Unfortunately, this configuration impairs design versatility because the cutout portion of the solar panel is easily seen through a dial plate, although the configuration can keep satisfactory antenna characteristics.

SUMMARY OF INVENTION

It is an object of the present invention to provide an electronic apparatus equipped with a solar panel that has excellent design appearance and satisfactory antenna characteristics for receiving GPS radio signals of circularly polarized waves.

In order to achieve the above object, an aspect of the present invention provides an electronic apparatus including a dial plate having light transparency, a module including an antenna for receiving circularly polarized waves which is disposed below the dial plate, the antenna having a radiation electrode, and a solar panel disposed between the dial plate and the module. The solar panel includes a common substrate, a plurality of solar cells disposed on the common substrate, and an inactive segment disposed on the common substrate at a place corresponding to the place of the radiation electrode.

BRIEF DESCRIPTION OF THE DRAWING

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

[First Embodiment]

An electronic apparatus according to a first embodiment of the present invention will now be described with reference to FIGS. 1 to 3.

The embodiments described below feature various technically preferred configurations for accomplishing the present invention. The scope of the present invention, however, should not be limited to the embodiments and examples shown below.

The electronic apparatus described in this embodiment is an analog timepiece that operates pointers to show time and other information.

Figure 1:
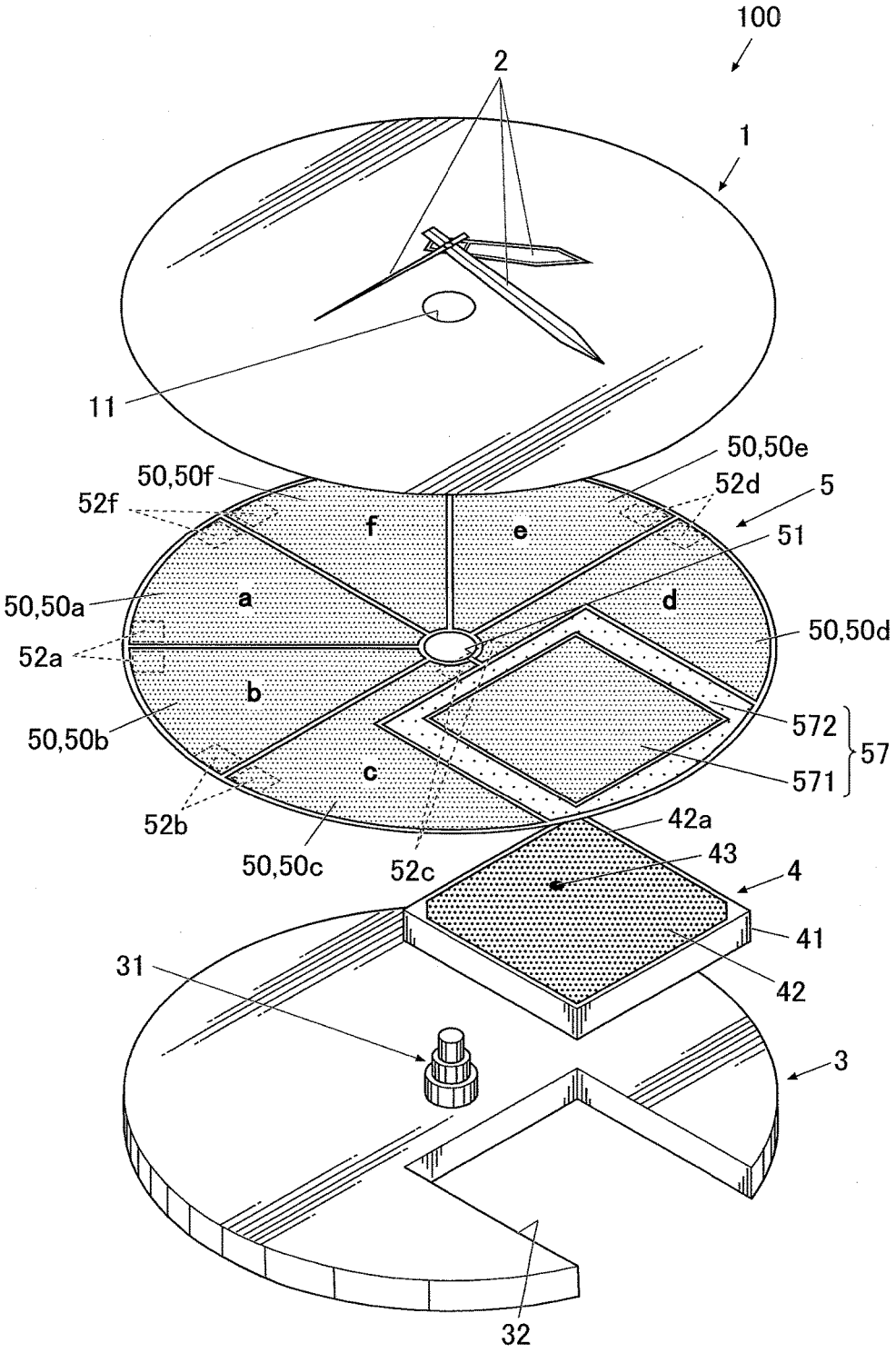
FIG. 1 is an exploded perspective view of a timepiece according to a first embodiment of the present invention.

FIG. 1 is an exploded perspective view of a timepiece according to this embodiment.

With reference to FIG. 1, a timepiece 100 according to this embodiment includes a dial plate 1, an antenna 4 for receiving circularly polarized signal waves included in a module 3, and a solar panel 5.

The timepiece 100 further includes a secondary battery (not shown) which functions as a power supply of the timepiece 100. Electricity generated in the solar panel 5 is accumulated in the secondary battery.

The dial plate 1, the module 3, the antenna 4, the solar panel 5 and the secondary battery are contained in a case (not shown).

In this embodiment, the dial plate 1 is disposed on a viewable side of the timepiece 100. The dial plate 1 is an analog dial plate that displays time with pointers 2 such as an hour hand and a minute hand.

A through-hole 11 for allowing the insertion of a pointer shaft 31 is formed at the substantial center of the dial plate 1. The pointers 2 are attached to the pointer shaft 31.

The timepiece 100 in this embodiment includes the antenna 4 for receiving circularly polarized GPS radio signals, which are microwaves as described later.

Thus, it is preferable that the dial plate 1 be composed of a non-metal material, such as a resin and glass, which can transmit the microwaves.

The timepiece 100 includes the solar panel 5 that converts light into electricity.

Thus, the dial plate 1 should be composed of a transparent or translucent material having light permeability.

The substrate of the dial plate 1 which is, for example, composed of a transparent or translucent resin or glass may have a metal film deposited on a surface of the substrate on condition that the metal film has a thickness which does not attenuate microwaves and does not impair the transmission of light. Appropriate printing may be provided on the surface of the substrate.

The module 3 is disposed below the dial plate 1 (in other words, on the back side of the timepiece 100). The module 3 includes a circuit board fitted with electronic parts (not shown) in a housing formed of a resin, for example. The electronic parts includes a timepiece movement composed, for example, of a train mechanism and a motor for operating the pointers 2; a communication module connected to the antenna 4; and a control circuit for the pointers 2 to display time.

The control circuit provided in the timepiece 100 according to this embodiment precisely corrects the time inside the timepiece 100 using time and other information contained in GPS radio signals.

In this embodiment, the pointer shaft 31, which is provided at the substantial center of the module 3, protrudes upward relative to the movement.

The pointer shaft 31 consists of a plurality of rotary shafts overlapped on the same axis. Each of the rotary shafts corresponds to and is connected to one of the pointers 2 including an hour hand, a minute hand and a second hand after the pointer shaft 31 is inserted in a through-hole 51 of the solar panel 5 described below and the through-hole 11 of the dial plate 1.

When a motion of the movement causes the pointer shaft 31 to rotate, the pointers 2 attached to the respective rotary shafts of the pointer shaft 31 individually rotate about the axis of the pointer shaft 31 on an upper surface of the dial plate 1.

The module 3 has a cutout or recess 32 to which the antenna 4 is fitted at a portion on its perimeter.

The cutout 32 has a shape that matches the outer shape of the antenna 4.

Preferably, an upper face of the module 3 should be substantially flush with the upper face of the antenna 4 fitted into the cutout 32.

The antenna 4 can receive GPS radio signals, that is, circularly polarized microwaves containing time and other information sent from GPS satellites. For example, the antenna 4 is preferably a patch antenna.

GPS radio signals contain time information supplied by a highly accurate atomic clock mounted on each of the GPS satellites; astronomical ephemerides (i.e. orbital information) on all the GPS satellites with moderate accuracy, which is updated about every six days; and astronomical ephemeris on the GPS satellite sending the GPS radio signals, which ephemeris is updated about every 90 minutes. Each GPS satellite sends such information in the form of radio signals (microwaves) at a frequency of either L1 (1575.42 MHz) or L2 (1227.60 MHz) to the earth.

The timepiece 100 receives GPS radio signals from at least any one of the GPS satellites via the antenna 4. The timepiece 100 then precisely corrects the time inside the timepiece 100 using time and other information contained in the GPS radio signals.

As described above, the GPS radio signals also contain information on the location of each GPS satellite in the orbit. Thus, the timepiece 100 can receive circularly polarized GPS radio signals sent from each of two or more GPS satellites via the antenna 4 and determine the position of the timepiece 100 using time, orbital and other information contained in the GPS radio signals.

With reference to FIG. 1, the antenna 4 according to this embodiment has a rectangular shape in plane view, and includes a base 41 and a radiation electrode 42 (a radiation element) disposed on the base 41.

The shape of the antenna 4 should not be limited to the example shown in the drawing.

The base 41 is formed of, for example, a dielectric material such as a ceramic material.

The radiation electrode 42 is made of, for example, a silver foil, a metallic plate, or a metal film with a predetermined thickness.

The dimensions of the radiation electrode 42 (e.g. the length of each side) are optimized based on the frequency and other characteristics of a radio signal the antenna 4 receives. In this embodiment, the dimensions of the radiation electrode 42 are adjusted so that the antenna 4 exhibits the most favorable receiving characteristics at frequencies for GPS radio signals.

A feeding point 43 for feeding electricity to the radiation electrode 42 is provided at a position that has a circular polarization characteristic in the antenna 4, that is, a position of impedance matching.

Electricity can be fed to the radiation electrode 42 in any manner.

A through-hole may be formed at a position corresponding to that of the feeding point 43 in the direction of the thickness of the antenna 4, so that a feeder (not shown), e.g. a feeding pin and a coaxial cable, for feeding electricity to the radiation electrode 42 is inserted in the through-hole.

As described above, the antenna 4 according to this embodiment is fitted into the cutout 32 of the module 3.

Figure 2:
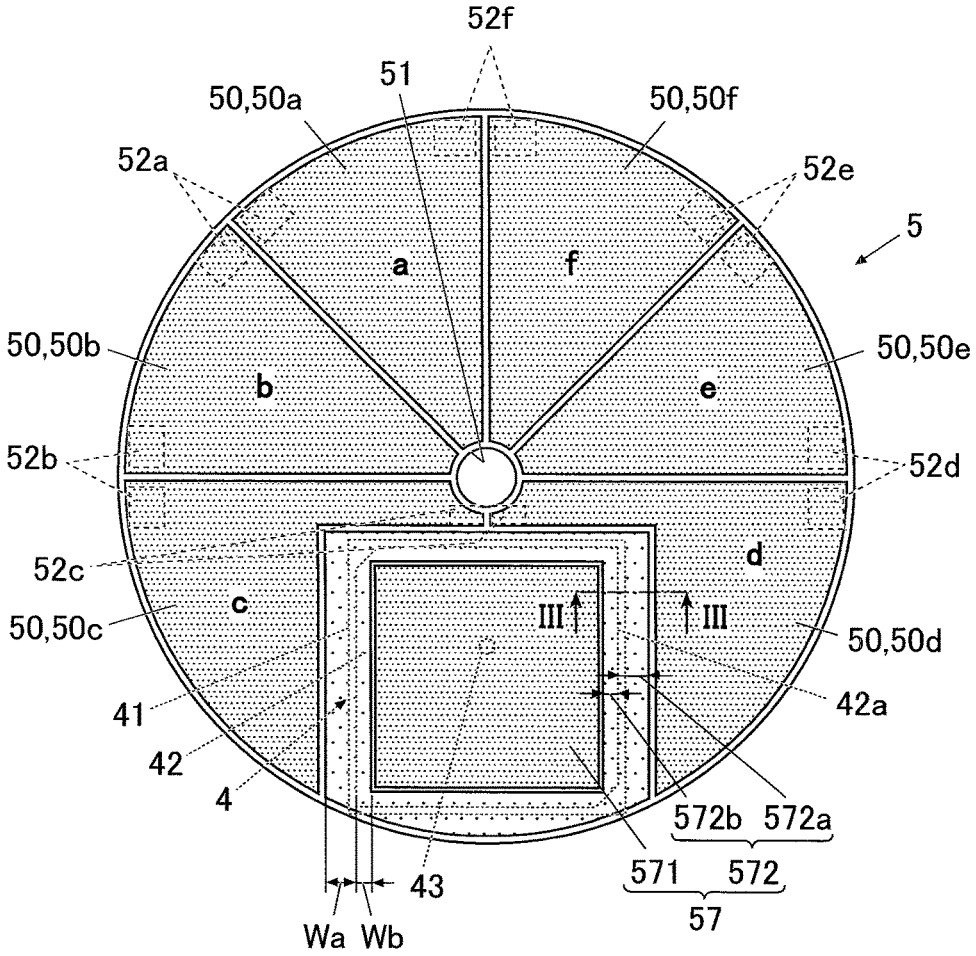
FIG. 2 is a plane view of a solar panel according to the first embodiment of the present invention.

With reference to FIG. 2, the antenna 4 fitted into the cutout 32 is disposed at a place that does not overlap the pointer shaft 31. The position and direction of the antenna 4 are not limited to those shown in the drawing.

The antenna 4 has a radiation pattern which extends from the outer edge (end) 42*a* of the radiation electrode 42.

In this embodiment, the radiation electrode 42 has a substantial square shape. The radiation pattern, which extends from each side (the outer edge 42*a*) of the radiation electrode 42, substantially influences the antenna characteristics (radio signal reception characteristics) of the antenna 4.

Thus, it is essential that the extension of the radiation pattern from the outer edge 42*a* of the radiation electrode 42 should not be obstructed so as to make the antenna characteristics of the antenna 4 satisfactory.

The solar panel 5 converts light into electricity. The electricity generated in the solar panel 5 is accumulated in the secondary battery.

In this embodiment, the solar panel 5 is disposed between the dial plate 1 and the module 3. The solar panel 5 has an area corresponding to that of the dial plate 1.

Since the dial plate 1 according to this embodiment is composed of a light-transmissive material as described above, the solar panel 5 can have a maximum area corresponding to that of the dial plate 1.

The solar panel 5 may have any shape and any other geometrical feature. The solar panel 5 may have an area that approximately corresponds to that of the dial plate 1, and may overlap approximately with the dial plate 1. The area and the shape of the solar panel 5 are not necessarily in exact agreement with those of the dial plate 1.

FIG. 2 is a plane view of the solar panel 5 according to this embodiment. FIG. 3 is a cross-sectional view of the solar panel 5 taken along the line III-III of FIG. 2.

With reference to FIGS. 1 and 2, the through-hole 51 for allowing the insertion of the pointer shaft 31 is provided at the substantial center of the solar panel 5.

The solar panel 5 according to this embodiment includes a plurality of solar cells 50 (six solar cells 50*a* to 50*f* in this embodiment) for receiving light, and an inactive segment 57 which do not receive light and which does not generate electricity.

The inactive segment 57 is disposed at a place corresponding to that of the radiation electrode 42 of the antenna 4. In this embodiment, the inactive segment 57 includes a dummy cell 571, i.e. a pseudo receiver having a configuration similar to that of the solar cells 50 (a laminated structure described later), and a non-conductive area 572 that is put around the dummy cell 571 and is composed of a non-conductive material.

The "place corresponding to that of the radiation electrode 42" denotes a place that is above the radiation electrode 42 and approximately overlaps with the radiation electrode 42.

As described above, the antenna 4 has a radiation pattern extending from the outer edge 42*a* of the radiation electrode 42. If the outer edge 42*a* of the radiation electrode 42 is covered with a member that blocks the transmission of radio signals, the antenna characteristics (radio signal reception characteristics) of the antenna 4 are impaired.

This disadvantage is avoided in this embodiment in which the non-conductive area 572 composed of a non-conductive material is disposed over and along the outer edge 42*a* of the radiation electrode 42. The non-conductive area 572 is included in the inactive segment 57 disposed above the radiation electrode 42.

This ensures that the dummy cell 571 inside the non-conductive area 572 is smaller than the radiation electrode 42. As a result, the dummy cell 571 containing a conductive member does not cover the outer edge 42*a* of the radiation electrode 42.

Specifically, the non-conductive area 572 according to this embodiment includes a rectangular outer frame 572*a* disposed outside the outline corresponding to the outer edge 42*a* of the radiation electrode 42, and a rectangular inner frame 572*b* disposed inside the outline.

A width Wa of the outer frame 572*a* is wider than a width Wb of the inner frame 572*b*. In this embodiment, the widths Wa and Wb are about 2 mm and about 1 mm, respectively.

For example, when the radiation electrode 42 in the antenna 4 is an 11.5 mm square and the outer frame 572*a* and the inner frame 572*b* have a width Wa of about 2 mm and a width Wb of about 1 mm, respectively, the characteristics of the antenna 4 are not impaired.

The widths, the shape and other geometrical features of the non-conductive area 572 should not be limited to the examples given here, but they are appropriately determined.

Preferably, the non-conductive area 572 should be formed so that the dummy cell 571 is disposed inside the outline corresponding to the outer edge 42*a* of the radiation electrode 42. Even if the dummy cell 571 almost overlaps the radiation electrode 42 in size (i.e. the inner frame 572*b* is little), the dummy cell 571 does not completely cover the outer edge 42*a* of the radiation electrode 42 depending on the distance between the dummy cell 571 and an upper face of the radiation electrode 42. In that case, the antenna 4 exhibits satisfactory antenna characteristics.

Figure 3:
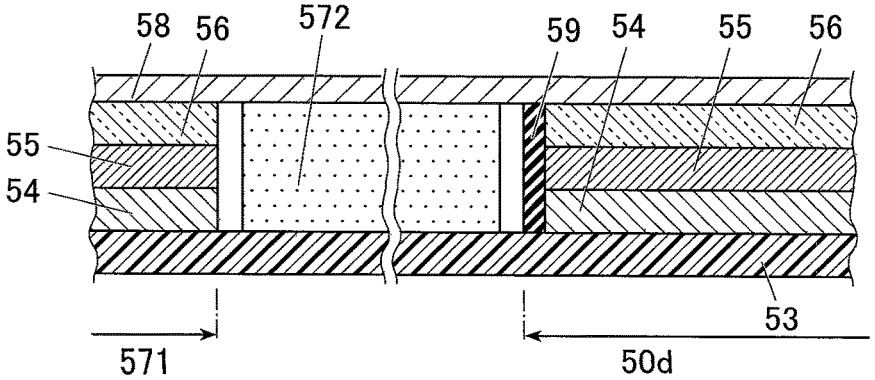
FIG. 3 is a cross-sectional view of the solar panel taken along the line of FIG. 2.

With reference to FIG. 3, the solar panel 5 has a laminated structure including a resin substrate 53, a metal electrode 54, a semiconductor layer 55, a transparent electrode 56, and a protective layer (a protective film) 58 in sequence. Each of the solar cells 50 and the dummy cell 571 is composed of the metal electrode 54, the semiconductor layer 55, and the transparent electrode 56.

An insulating layer 59 is disposed on each side of the laminated structure consisting of the metal electrode 54, the semiconductor layer 55, and the transparent electrode 56 of each of the solar cells 50*c* and 50*d*.

The resin substrate 53 is a flexible film substrate. The resin substrate 53 is composed of a material including but not limited to plastics.

The metal electrode 54 is composed of a metallic material such as aluminum.

The metal electrode 54 may be composed of any other conductive material.

The semiconductor layer 55 is composed of, for example, amorphous silicon (a-Si:H).

The semiconductor layer 55 is, for example, a p-n junction semiconductor, which is produced by joining p-type and n-type semiconductors.

The metal electrode 54 and the semiconductor layer 55 are stacked, in sequence, on the resin substrate 53 by, for example, evaporation.

The metal electrode 54 and the semiconductor layer 55 may be deposited on the resin substrate 53 by any other means.

The transparent electrode 56 is formed by crystallizing, for example, zinc oxide, indium oxide, or tin oxide on a substrate, such as glass. The transparent electrode 56 may be formed with any material and by any method, other than these examples.

In the solar panel 5, the non-conductive area 572 surrounding the periphery of the dummy cell 571 is formed by partly removing the laminated structure of the metal electrode 54, the semiconductor layer 55 and the transparent electrode 56 around the dummy cell 571 and filling a space corresponding to the removed portion with a non-conductive material with a color similar to that of the dummy cell 571 (the solar cells 50).

Preferably, the non-conductive area 572 and the adjacent solar cells 50, and the dummy cell 571 are separated from each other by small gaps.

Even if a difference in level exists between the upper surface of the non-conductive area 572 and the upper surface of any one of the adjacent solar cells 50 and the dummy cell 571, such gaps can obscure the difference in level.

The method of partly removing the laminated structure of the metal electrode 54, the semiconductor layer 55, and the transparent electrode 56 includes but not limited to laser processing. Furthermore, the metal electrode 54, the semiconductor layer 55, and the transparent electrode 56 may be stacked outside a space where the non-conductive area 572 is to be provided (i.e. a space located above the outer edge 42*a* of the radiation electrode 42) instead of partly removing the laminated structure of the metal electrode 54, the semiconductor layer 55, and the transparent electrode 56.

With reference to FIGS. 1 and 2, the six solar cells 50*a* to 50*f* in this embodiment have substantial equal areas so that these solar cells can generate substantially equal amounts of electric current.

The solar cells 50*a* to 50*f* are connected in series, and function as a single solar panel.

Specifically, the solar cell 50*a* is electrically connected to the adjacent solar cell 50*b* at a connection 52*a*. The solar cell 50*b* is electrically connected to the adjacent solar cell 50*c* at a connection 52*b*.

Similarly, the solar cells 50*c* to 50*e* are electrically connected to the adjacent solar cells 50*d* to 50*f* at connections 52*c* to 52*e*, respectively.

For example, a connection 52*f* of the solar cell 50*a* is independent of a connection 52*f* of the solar cell 50*f*. These connections 52*f* and 52*f* are connected with connectors (connection members, not shown).

The connectors are each connected to an anode and a cathode on the circuit board (not shown), so that the solar panel 5 is electrically connected to the circuit board.

The connection connected to the circuit board is not limited to the connections 52*f* and 52*f*. Any of the connections 52*a* to 52*f* may have such a configuration.

The connections 52*a* to 52*f* may have any position and any shape, other than the examples shown in FIGS. 1 and 2.

The assembly and operation of the timepiece 100 according to this embodiment will now be described.

In assembly of the timepiece 100 according to this embodiment, a solar panel 5 composed of solar cells 50 and a dummy cell 571 is formed.

The laminated structure of the metal electrode 54, the semiconductor layer 55 and the transparent electrode 56 around the dummy cell 571 in the solar panel 5 are partly removed by laser processing, for example. The space corresponding to the removed portion is filled with a non-conductive material so as to form the non-conductive area 572.

The photoreceptive surfaces of the solar cells 50*a* to 50*f* are connected in series at the connections 52*a* to 52*f*, respectively. At the same time, a connector (a connection member, not shown) is connected to, for example, each of the connection 52*f* of the solar cell 50*a* and the connection 52*f* of the solar cell 50*f* (any of the connections 52*a* to 52*f* can be selected). The connectors are then connected to an anode and a cathode, respectively, on the circuit board (not shown).

The solar panel 5 is thereby electrically connected to the circuit board. Such connection can accumulate electricity generated in the solar panel 5 in a secondary battery.

The antenna 4 is fit into the cutout 32 on the module 3. The position of the solar panel 5 is adjusted such that the dummy cell 571 is disposed above the antenna 4, and then the solar panel 5 is disposed over the module 3. The dial plate 1 is disposed on the solar panel 5 and the assembly is placed in the case.

The pointers 2 is attached to the pointer shaft 31 extending from the module 3 through the solar panel 5 and protruding from the dial plate 1. A wind protector (not shown) formed of transparent glass is mounted on the upper surface (viewable side) of the case over the dial plate 1.

The assembly of the timepiece 100 is thereby completed.

Light passes through the wind protector and the dial plate 1 from the viewable side of the timepiece 100 according to this embodiment, enters the solar panel 5 composed of the solar cells 50*a* to 50*f*, and passes through the transparent electrode 56 to enter the semiconductor layer 55.

The light entering the semiconductor layer 55 generates electrons and positive holes near the p-n junction between the p-type and n-type semiconductors.

The electrons and the positive holes move to the n-type semiconductor and the p-type semiconductor, respectively to generate an electromotive force (photovoltaic force).

As a result, an electric current is fed to a circuit connected to the transparent electrode 56 and the metal electrode 54.

Electricity generated in the solar panel 5 in this way is charged in the secondary battery.

GPS radio signals pass through the wind protector and the dial plate 1 in the timepiece 100 and reach the antenna 4.

As described above, conductive members, such as the metal electrode 54, the semiconductor layer 55, and the transparent electrode 56, in the solar cells 50 and the dummy cell 571, do not cover the outer edge 42*a* of the radiation electrode 42 in the antenna 4. Thus, the extension of the radiation pattern from the outer edge 42*a* is not obstructed and the antenna 4 can satisfactorily receive the GPS radio signals.

GPS radio signals received by the antenna 4 are sent to the control circuit (not shown) in the module 3. The control circuit precisely corrects the time inside the timepiece 100 using time information and other information in the GPS radio signals.

As described above, in the solar panel 5 according to this embodiment, the inactive segment 57 including the non-conductive area 572 is disposed at a place corresponding to that of the radiation electrode 42 in the antenna 4.

Thus, the conductive material does not cover the outer edge 42*a* of the radiation electrode 42.

Consequently, the antenna characteristics of the antenna 4 are not impaired and the antenna 4 can satisfactorily receive GPS radio signals containing time information and other information.

Moreover, the solar panel 5 according to this embodiment includes the solar cells 50 and the inactive segment 57 which are disposed on the single resin substrate 53, the inactive segment 57 being located at a place corresponding to that of the radiation electrode 42 in the antenna 4.

Thus, the solar panel 5 according to this embodiment barely creates a difference in level and a gap between the inactive segment 57 and other members, which in turn barely produce a shadow and an uneven spot, in contrast to a conventional solar panel which has a cutout at a portion facing an antenna for receiving circularly polarized waves.

As a result, when the timepiece 100 is viewed through the dial plate 1, a boundary line around the antenna 4 is obscured and the timepiece 100 can have improved design appearance.

In this embodiment, the inactive segment 57 of the solar panel 5 includes the non-conductive area 572 composed of a non-conductive material, which is disposed over and along the outer edge 42*a* of the radiation electrode 42, and the dummy cell 571 having a configuration similar to that of the solar cells 50, which is disposed inside the non-conductive area 572.

Thus, when the timepiece 100 is viewed through the dial plate 1, the dummy cell 571 looks similar to the solar cells 50. This makes it easy to strike a proper balance between the inactive segment 57 and other members in color tone and other appearances.

The non-conductive area 572 is formed by only removing part of the laminated structure of the metal electrode 54, the semiconductor layer 55 and the transparent electrode 56 around the dummy cell 571 by, for example, laser processing. This process can reduce the amount of the removed portion compared to the amount when the entire inactive segment 57 is removed. This contributes to a reduction in time for the removing process.

Figure 4:
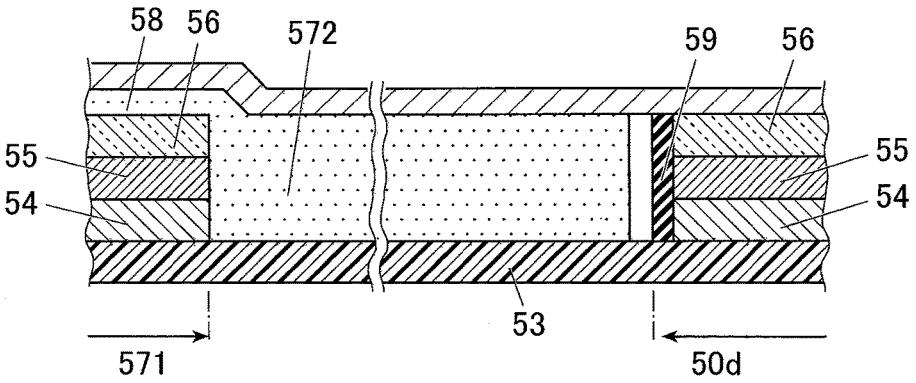
FIG. 4 is a cross-sectional view illustrating a variation of the solar panel of FIG. 3.

In this embodiment, it is preferable that the dummy cell 571 be separated from the non-conductive area 572 by a gap. Alternatively, with reference to FIG. 4, a non-conductive material forming the non-conductive area 572 may coat the upper face of the dummy cell 571. In this case, no gap is provided between the non-conductive area 572 and the dummy cell 571.

In this configuration, the boundary line is even more obscured between the non-conductive area 572 and the dummy cell 571 and the timepiece 100 can have further improved design appearance.

[Second Embodiment]

An electronic apparatus according to a second embodiment of the present invention will now be described with reference to FIG. 5.

The second embodiment differs from the first embodiment in the configuration of the solar panel. Only dissimilarities between the first and second embodiments are described below. Structural elements identical to those of the first embodiment are assigned with the same reference numerals, and their redundant descriptions are omitted.

Figure 5:
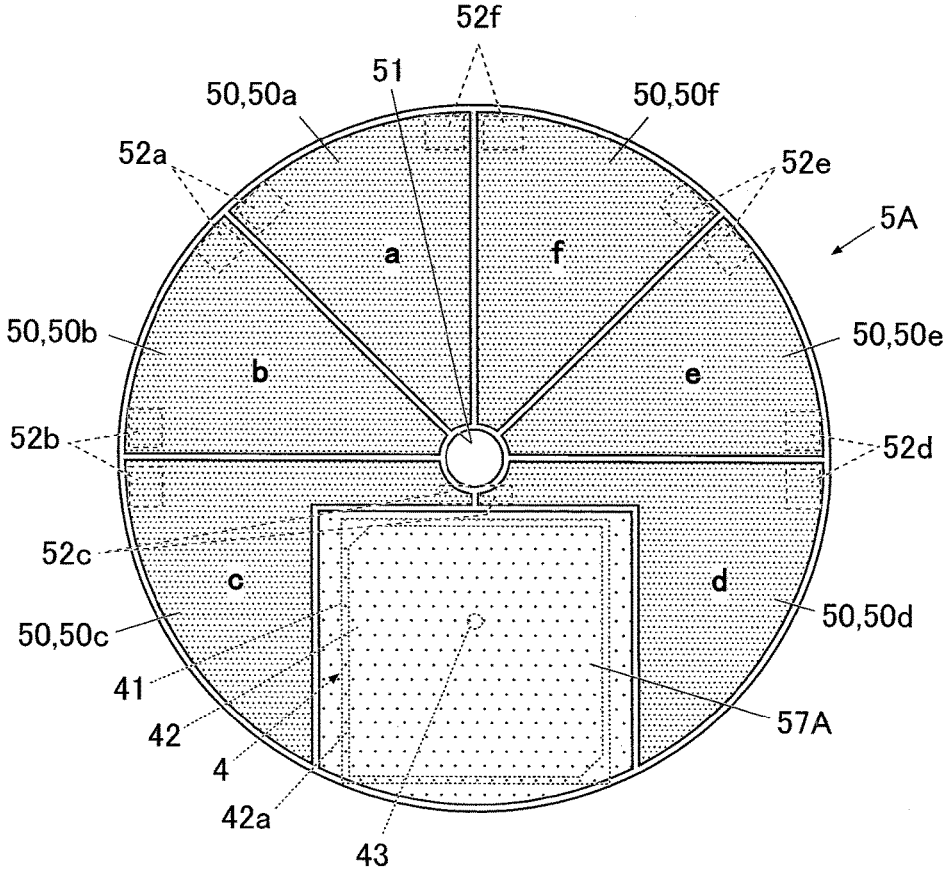
FIG. 5 is a plane view of a solar panel according to a second embodiment.

FIG. 5 is a plane view of a solar panel according to this embodiment.

With reference to FIG. 5, a solar panel 5A according to this embodiment includes a plurality of solar cells 50 for receiving light, and an inactive segment 57A which does not receive light and does not generate electricity.

Like the inactive segment 57 of the first embodiment, the inactive segment 57A according to this embodiment is disposed at a place corresponding to that of the radiation electrode 42 in the antenna 4.

The inactive segment 57A in this embodiment is, however, composed of a non-conductive material. The inactive segment 57A is formed into a shape corresponding to that of the radiation electrode 42 and is larger than the radiation electrode 42.

In other words, in this embodiment, the inactive segment 57A composed of a non-conductive material is disposed over the radiation electrode 42 so as to entirely cover the radiation electrode 42.

Consequently, the solar cells 50 containing a conductive member do not cover the outer edge 42*a* of the radiation electrode 42.

Like the non-conductive area 572 in the first embodiment, the inactive segment 57A according to this embodiment is formed by removing part of the laminated structure of the metal electrode 54, the semiconductor layer 55 and the transparent electrode 56 disposed on the resin substrate 53 and filling the space corresponding to the removed portion with a non-conductive material with a color similar to that of the solar cells 50 (refer to FIG. 3).

Preferably, the inactive segment 57A and the adjacent solar cells 50 are separated from each other by small gaps.

Even if a difference in level exists between the upper surface of the inactive segment 57A and the upper surface of any of the adjacent solar cells 50, such small gaps can obscure the difference in level.

Since the other structural elements and functions are substantially the same as those of the first embodiment, redundant descriptions on them are omitted.

As described above, this embodiment produces advantageous effects similar to those of the first embodiment.

Specifically, since the outer edge 42*a* of the radiation electrode 42 is not covered with conductive material, the antenna characteristics of the antenna 4 are not impaired and the antenna 4 can satisfactorily receive GPS radio signals containing time information and other information.

The solar panel 5A barely creates a level difference and a space between the inactive segment 57A and other members formed on the single resin substrate 53. Thus, when the timepiece 100 is viewed through the dial plate 1, a boundary line around the antenna 4 is obscured and the timepiece 100 can have improved design appearance.

[Third Embodiment]

An electronic apparatus according to a third embodiment of the present invention will now be described with reference to FIG. 6.

The third embodiment differs from the first embodiment in the configuration of the solar panel. Only dissimilarities between the first and third embodiments are described below. Structural elements identical to those of the first embodiment are assigned with the same reference numerals, and their redundant descriptions are omitted.

Figure 6:
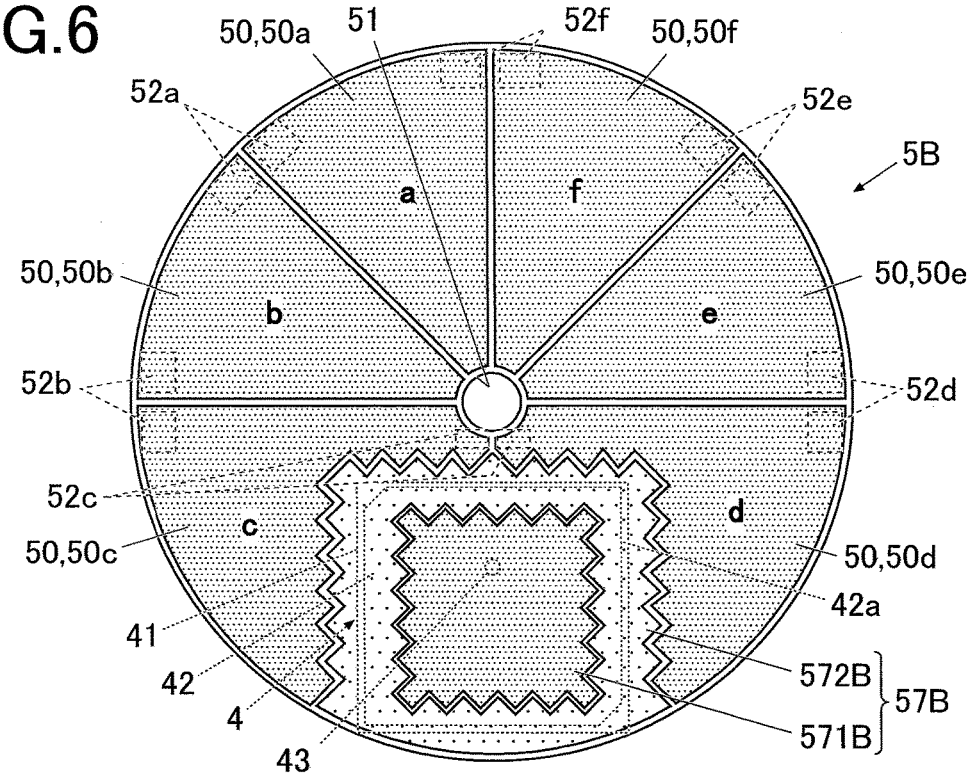
FIG. 6 is a plane view of a solar panel according to a third embodiment.

FIG. 6 is a plane view of a solar panel according to this embodiment.

With reference to FIG. 6, a solar panel 5B according to this embodiment includes a plurality of solar cells 50 for receiving light, and an inactive segment 57B which does not receive light and does not generate electricity.

Like the inactive segment 57 of the first embodiment, the inactive segment 57B according to this embodiment is disposed at a place corresponding to that of the radiation electrode 42 of the antenna 4. The inactive segment 57B includes a dummy cell 571B, i.e. a pseudo receiver having a configuration similar to that of the solar cells 50, and a non-conductive area 572B that is put around the dummy cell 571B and is composed of a non-conductive material.

The inactive segment 57B according to this embodiment, however, has an outer edge of a periodic sawtooth pattern for primary purpose of improved design appearance.

The dummy cell 571B included in the inactive segment 57B according to this embodiment also has an outer edge of a periodic sawtooth pattern similar to that of the inactive segment 57B.

In other words, according to this embodiment, the non-conductive area 572B and the adjacent solar cells 50 form a sawtooth-shaped boundary line between them, and the non-conductive area 572B and the dummy cell 571B also form a sawtooth-shaped boundary line between them.

The outer edge of the inactive segment 57B, however, may have any periodic pattern other than the sawtooth pattern, for example, a sinusoidal pattern.

Furthermore, the inactive segment 57B may have an outer edge of a non periodic pattern with attractive design appearance which obscures a boundary line around the antenna 4.

Since the other structural elements and functions are substantially the same as those of the first embodiment, redundant descriptions on them are omitted.

As described above, this embodiment can produce the advantageous effects below in addition to the advantageous effects similar to those of the first embodiment.

Specifically, the inactive segment 57B, which is included in the solar panel 5B and is disposed at a place corresponding to that of the radiation electrode 42 of the antenna 4, has an outer edge of a periodic pattern.

Thus, when the timepiece 100 is viewed through the dial plate 1, the inactive segment 57B having an outer edge of a periodic pattern can more effectively obscure a boundary line around the antenna 4 and make the boundary line confused with the adjoining design feature than an inactive segment having a linear outer edge does.

Figure 7:
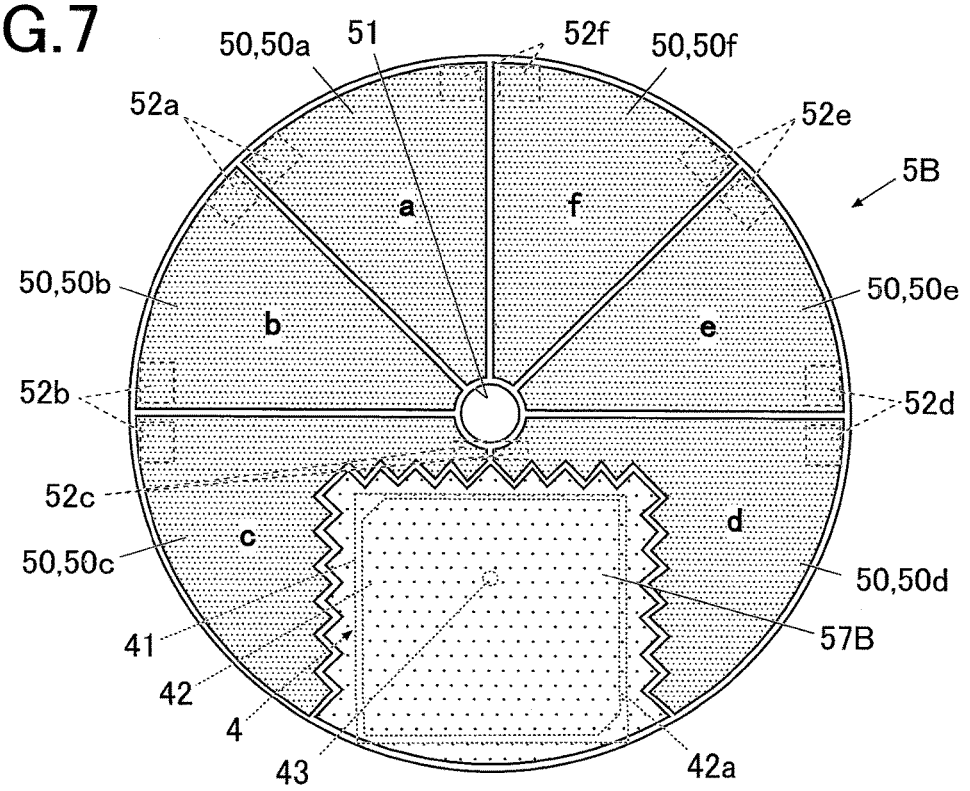
FIG. 7 is a plane view illustrating a modified example of the solar panel of FIG. 6.

In this embodiment described above, the inactive segment 57B includes the dummy cell 571B. With reference to FIG. 7, the dummy cell 571B can be omitted from the inactive segment 57B.

In other words, like the inactive segment 57A of the second embodiment, an inactive segment 57B composed of a non-conductive material may be disposed over the radiation electrode 42 so as to entirely cover the radiation electrode 42.

The scope of the present invention should not be limited to the first to third embodiments, and should include various modifications and alterations without deviating from the gist of the present invention.

In the embodiments described above, a single antenna 4 is provided, for example. Instead, two or more antennas 4 can be provided on the timepiece.

When a plurality of antennas 4 is provided, all the dummy cells included in the respective inactive segments disposed at respective places corresponding to those of the respective radiation electrodes 42 should be adjusted in size and shape so that all the dummy cells are inside the respective radiation electrodes 42.

In the first and third embodiments described above, the dummy cell in the inactive segment, which is disposed at a place corresponding to that of the radiation electrode 42, is disposed inside an outline corresponding to the outer edge 42*a* of the radiation electrode 42, for example. If the radiation electrode 42 includes any of a slit and a cutout formed on it, the dummy cell should be preferably formed such that the dummy cell is disposed at the inner side of positions corresponding to those of the slit and the cutout.

The solar panel may be divided in any manner (the number of divisions, the shape of each solar cell, and other divisional features), other than the examples shown in the embodiments.

In the embodiments described above, the electronic apparatus is exemplified with an analog timepiece 100 which rotates the pointers 2 on the dial plate 1 to display time and other information. Alternatively, the timepiece may be of any other type.

For example, the timepiece may be a digital timepiece equipped with a dial plate (e.g. a liquid crystal display) for showing time, calendar data, and other information with letters and other symbols. Alternatively, the electronic apparatus may be provided with a dial plate which includes both an analog display and a digital display.

In the embodiments described above, an electronic apparatus in accordance with the present invention is a timepiece. The electronic apparatus should, however, be not limited to timepieces.

An electronic apparatus in accordance with the present invention receives GPS radio signals via an antenna for receiving circularly polarized waves to obtain time information and other information, converts light into electricity in a solar panel and operates using the converted electricity as a driving source. For example, the electronic apparatus may be a biometric information display device such as a pedometer, a heart rate meter or pulsimeter, or a device displaying travel distance and travel rate information, altitude and atmospheric pressure information, or other kinds of information.

The scope of the present invention should not be limited to the embodiments described above, and should be interpreted based on the claims and equivalents thereof within the gist of the present invention.

The entire disclosure of Japanese Patent Application No. 2014-063373 filed on Mar. 26, 2014 including description, claims, drawings, and abstract are incorporated herein by reference in its entirety.

What is claimed is:

1. An electronic apparatus comprising:

a dial plate having light transparency;

a module including an antenna for receiving circularly polarized waves which is disposed below the dial plate, the antenna having a radiation electrode; and a solar panel disposed between the dial plate and the module, wherein the solar panel includes:

a common substrate;

a plurality of solar cells disposed on the common substrate; and an inactive segment disposed on the common substrate at a place corresponding to a place of the radiation electrode, and wherein the inactive segment includes:

a non-conductive area formed of a non-conductive material, the non-conductive area being disposed over and along an outer edge of the radiation electrode; and a dummy cell disposed inside the non-conductive area, each of the dummy cell and the solar cells comprising a laminated structure of a first electrode layer, a semiconductor layer, and a transparent electrode layer, wherein:

the solar cells, the non-conductive area and the dummy cell are disposed on a same plane, and the solar cells, the non-conductive area, and the dummy cell each have a same height and a same thickness; and the non-conductive area includes a substantially rectangular outer frame disposed outside an outline corresponding to the outer edge of the radiation electrode, and a substantially rectangular inner frame disposed inside the outline.

2. The electronic apparatus of claim 1, wherein the inactive segment has a shape corresponding to a shape of the radiation electrode and is larger than the radiation electrode.

3. The electronic apparatus of claim 1, wherein the outer frame is wider than the inner frame.

4. The electronic apparatus of claim 1, wherein the non-conductive material of the non-conductive area covers an upper face of the dummy cell.

5. The electronic apparatus of claim 1, wherein the inactive segment has an outer edge of a periodic pattern.

* * * * *